US006422649B2

(12) United States Patent
Hancock

(10) Patent No.: US 6,422,649 B2
(45) Date of Patent: Jul. 23, 2002

(54) CHAIR

(75) Inventor: William John Hancock, Wexford (IE)

(73) Assignee: Ashfield Engineering Company Wexford Limited, Wexford (IL)

( * ) Notice: Subject to any disclaimer, the term of this patent is extended or adjusted under 35 U.S.C. 154(b) by 0 days.

(21) Appl. No.: 09/767,944

(22) Filed: Jan. 24, 2001

Related U.S. Application Data

(63) Continuation of application No. PCT/IE99/00078, filed on Jul. 27, 1999.

(30) Foreign Application Priority Data

| | | |
|---|---|---|
| Jul. 27, 1998 | (IE) | 980624 |
| Oct. 29, 1998 | (IE) | 980890 |
| Oct. 29, 1998 | (IE) | 980891 |
| Oct. 29, 1998 | (IE) | 980892 |
| Oct. 29, 1998 | (IE) | 980893 |
| Dec. 23, 1998 | (IE) | S981098 |
| Jun. 9, 1999 | (IE) | 990481 |

(51) Int. Cl.[7] ..... A47C 7/60
(52) U.S. Cl. ..... 297/301.5; 297/312
(58) Field of Search ..... 297/301.4, 301.1, 297/300.1, 300.2, 300.5, 313, 301.5, 337, 300.6

(56) References Cited

U.S. PATENT DOCUMENTS

| | | | | |
|---|---|---|---|---|
| 3,224,807 A | * | 12/1965 | Welch et al. | |
| 3,250,567 A | * | 5/1966 | Parrott | |
| 3,386,770 A | * | 6/1968 | Williams | |
| 3,989,297 A | | 11/1976 | Kerstholt | 297/300 |
| 4,364,605 A | | 12/1982 | Meiller | 297/306 |
| 4,521,053 A | | 6/1985 | de Boer | 297/312 |
| 4,529,247 A | | 7/1985 | Stumpf et al. | 297/301 |
| 4,589,697 A | | 5/1986 | Bauer et al. | 297/300 |
| 4,709,963 A | | 12/1987 | Uecker et al. | 297/316 |
| 4,911,501 A | | 3/1990 | Decker et al. | 297/300 |
| 4,986,601 A | * | 1/1991 | Inoue | |
| 5,048,893 A | | 9/1991 | Cowan et al. | 297/329 |
| 5,871,256 A | * | 2/1999 | Kogai | |
| 5,964,503 A | * | 10/1999 | Inoue | |

FOREIGN PATENT DOCUMENTS

| | | |
|---|---|---|
| EP | 0801913 A1 | 10/1997 |
| FR | 1249297 | 11/1959 |
| FR | 2215186 | 8/1974 |
| GB | 2165445 A | 4/1986 |
| WO | WO95/20896 | 8/1995 |

* cited by examiner

*Primary Examiner*—Milton Nelson, Jr.
(74) *Attorney, Agent, or Firm*—Jacobson Holman, PLLC

(57) ABSTRACT

A chair has a seat and a backrest which are independently pivotable within limits at extremities. The seat is biased upwardly at the front and the backrest is biased forwardly. The seat and the backrest have a common pivot joint, under the center of gravity of the occupant. There are no occupant-operated controls as the chair responds automatically to the posture of the occupant, providing full support at all relative positions of the seat and the backrest in a balanced manner for occupants of a wide range of weights.

39 Claims, 8 Drawing Sheets

CHAIR

This application is a continuation of PCT/IE 99/00078 filed Jul. 27, 1999.

FIELD OF THE INVENTION

The invention relates to a chair of the type which allows movement of its backrest and seat.

PRIOR ART DISCUSSION

Typically, chairs have been designed with functional details of the chair parts and the mechanism in mind rather than response to health or supportive movement of the occupant. While this approach tends to provide a chair which is reasonably reliable and conforms to safety standards, the chair is typically not particularly comfortable and supportive. Also, this approach does little to reduce the risk of repetitive strain injury (RSI) caused by a mainly static support system.

European Patent Specification No. 22933 (Grammer) describes a chair having a seat and a backrest which are set to positions to provide static support. The gas struts appear to act as dampers which are set to positions according to occupant movement of an actuating lever. Forward movement of the lever adjust the seat gas strut and rearward movement adjusts the backrest gas strut U.S. Pat. No. 4,521,053 describes a chair in which a backrest part has a front seat portion. These chairs appear to do little to respond to the posture of the occupant and both require adjustment to suit the particular occupant.

PCT patent specification No. WO87/06810 (Savo) describes a chair in which the seat and the backrest are curved where they join and they overlap each other so that their pivot axes are through an imaginary axis of the hip joint of the occupant. While this approach is undoubtedly an improvement because it takes into account the anatomy of the occupant, it appears that the mechanism would be relatively complex to manufacture because of the need for the backrest and the seat to overlap each other and rotate without the benefit of a conventional pivotal joint. Also, this chair does not appear to provide comprehensive support of the torso and legs for different postures.

In general, a major problem with chairs is that they require the occupant to actively and consciously control the chair using actuators to achieve a supportive and comfortable configuration of the chair. An example is the adjustment of a strong spring at the front of a chair to set a required pressure according to the weight of the occupant. Further, the configuration which is reached is either static or provides synchronised seat and backrest tilting. If static, RSI may be a problem. If synchronised, the chair effectively imposes a range of seat/backrest configurations irrespective of the natural posture of the occupant.

OBJECTS OF THE INVENTION

It is therefore an object of the invention, to provide a chair which actively provides comprehensive support and promotes and induces joint movement of the user at all times ( is "posture-responsive"), while the role played by the occupant is passive (there is no need for actuators or for the occupant to become actively involved in any way).

Another object is to provide a chair having a very simple and robust construction.

SUMMARY OF THE INVENTION

According to the invention, there is provided a chair comprising a seat, a backrest, and a fixed support, wherein the seat and the backrest are independently pivotable and are biassed to provide posture-responsive support of an occupant.

In one embodiment, the seat is biassed upwardly at the front and the backrest is biassed forwardly whereby the bias forces are contra-rotational about an occupant's centre of gravity.

In one embodiment, the backrest bias is transferred to the seat by abutment of the backrest with the seat at some relative positions of the seat and the backrest.

In one embodiment, the seat and the backrest are pivotally mounted on the fixed support.

In one embodiment, the seat is biassed upwardly at the front by a spring acting between the fixed support and the seat forwardly of the seat pivot axis, and the backrest is biassed forwardly by a spring acting between the fixed support and the backrest rearwardly of the backrest pivot axis.

In another embodiment, the fixed support comprises a stop means which sets extremities of independent movement of the seat.

In one embodiment, the fixed support comprises a stop means which sets a rearward extremity of movement of the backrest, and a forward extremity of the backrest is set by abutment with the seat.

In one embodiment, the seat and the backrest are pivotally mounted and the pivot axes are located substantially in the same vertical plane as the centre of gravity of an occupant sitting on the chair.

In a further embodiment, the seat and the backrest pivot axes are coincident.

Preferably, the pivot axes extend through the fixed support.

In one embodiment, the backrest and seat pivot axes comprise a pivot pin extending through the fixed support.

In one embodiment, the backrest comprises a pair of lateral supports interconnected by a pivot joint extending through the fixed support.

In one embodiment, the backrest further comprises a cross-member interconnecting the lateral supports rearwardly of the pivot joint.

In one embodiment, the cross-member is acted upon by a bias means urging the backrest forwardly.

In another embodiment, the fixed support is of U-shaped channel construction and the seat comprises a seat support nested within the fixed support.

In one embodiment, the seat support is of inverted U-shaped channel construction.

In one embodiment, the backrest is biassed forwardly by at least two springs, whereby all springs act at a rearward extremity of the backrest and at least one spring ceases to act as the backrest moves forward.

In one embodiment, the chair further comprises a safety mechanism comprising means for preventing tilting of the seat downwardly at the front if the occupant is sitting at the front edge of the seat.

According to another embodiment, the invention provides a chair mechanism comprising:

fixed support, a seat support comprising means for supporting a seat pad, and a backrest support comprising means for supporting a backrest pad, wherein the seat support and the backrest support are independently pivotable and are biassed to provide posture-responsive support of an occupant of a chair as defined above.

DETAILED DESCRIPTION OF THE INVENTION

Brief Description of the Drawings

The invention will be more clearly understood from the following description of some embodiments thereof, given by way of example only with reference to the accompanying drawings in which.

DESCRIPTION OF THE EMBODIMENTS

Figure 1:
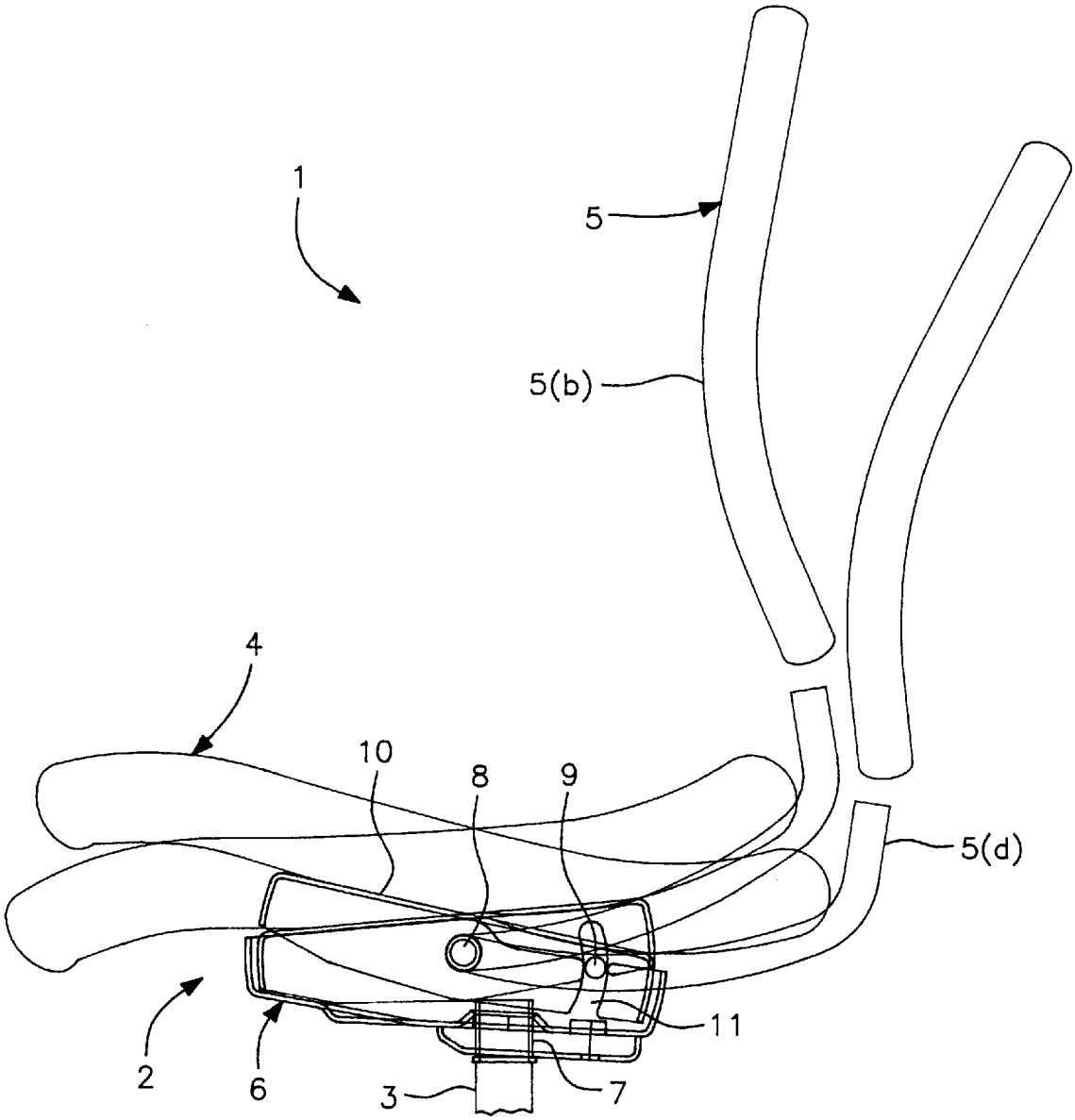
FIG. 1 is a diagrammatic side view of a chair of the invention showing two seat and backrest positions.

Referring to the drawings, there is shown a chair 1 having a mechanism 2. The chair 1 comprises a pedestal 3, a seat 4, and a backrest 5. The mechanism 2 comprises a fixed support 6 having a socket 7 for receiving the chair pedestal 3.

A pivot pin 8 extends through the fixed support 6. The pivot pin 8 is part of a backrest support of the backrest 5. The backrest support also comprises a cross-bar 9 which extends through the fixed support 6. A pair of laterally spaced-apart arms 5(*a*) at the sides of the mechanism are interconnected by the pivot pin 8 and the cross bar 9. These arms extend upwardly at the back to support a backrest pad 5(*b*).

Figure 2:
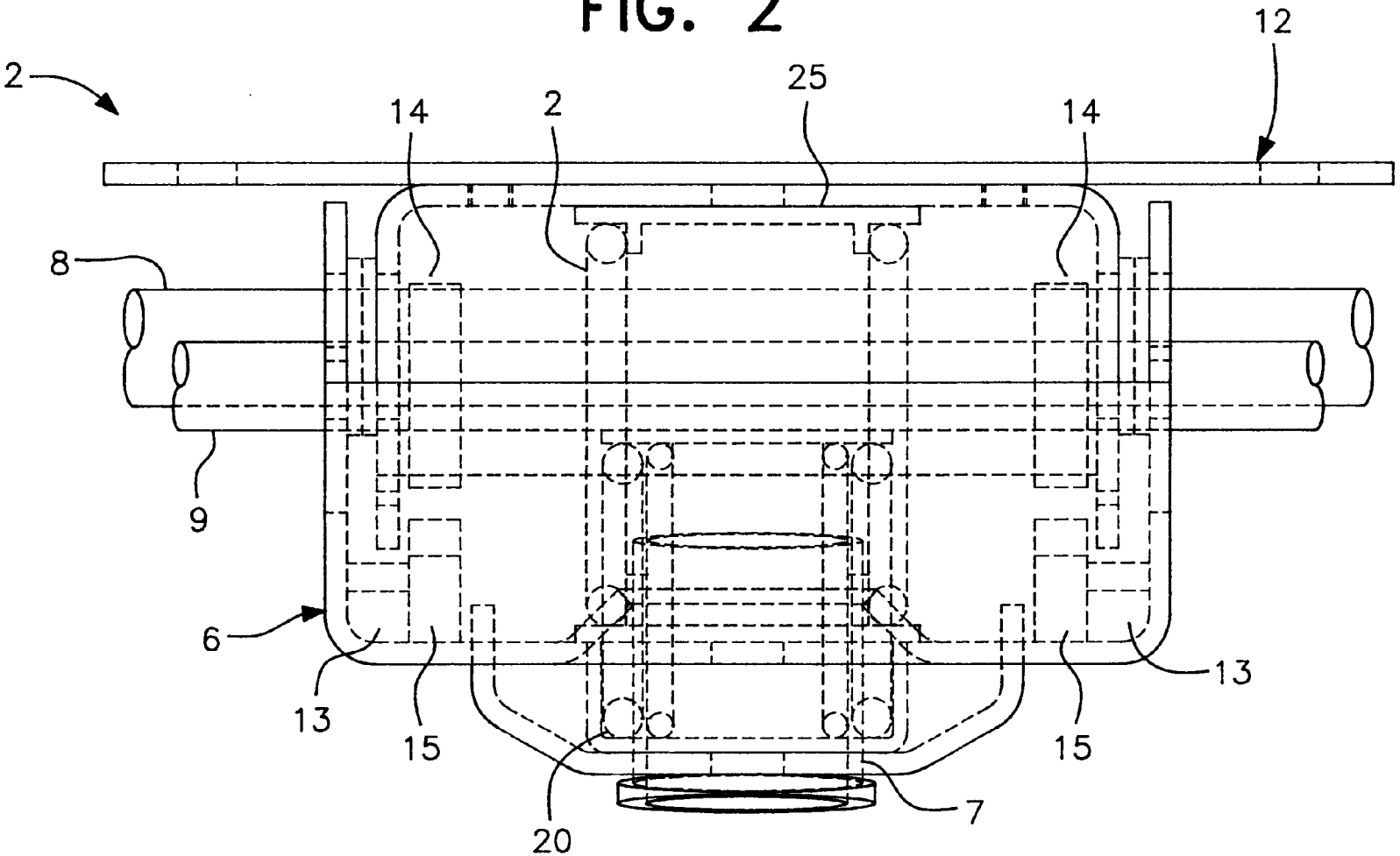
FIG. 2 is a rear view of a chair mechanism of the chair.
Figure 3:
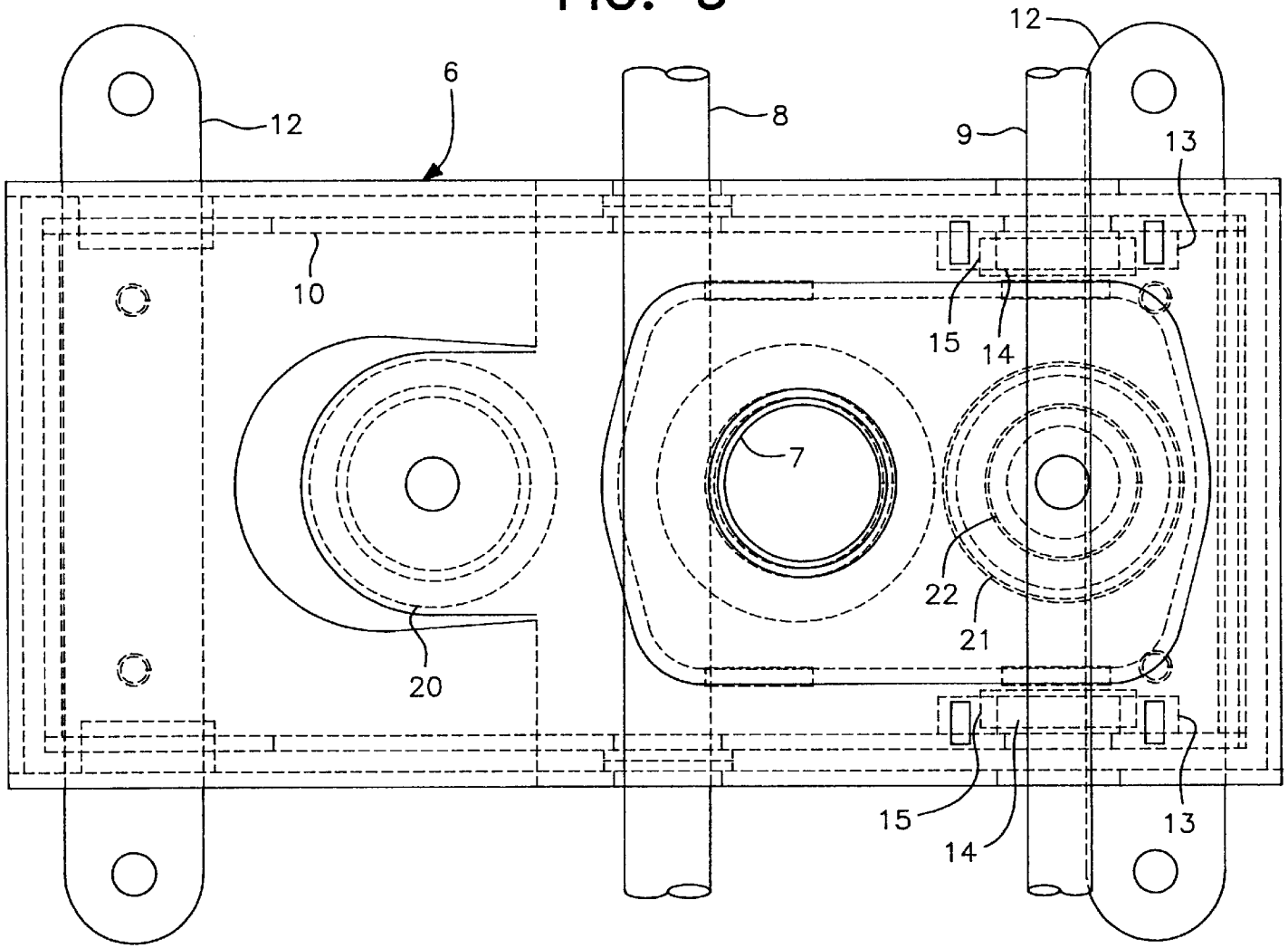
FIG. 3 is an underneath plan view of the mechanism.

The mechanism 2 also comprises a seat support 10 which rotates about the pivot pin 8. The seat support 10 comprises an arcuate slot 11 through which the cross-bar 9 of the backrest support extends. As shown in FIGS. 2 and 3, the seat support 10 comprises upper lateral fixing brackets 12 connected to a seat pad.

Nylon stops 13 are mounted in the fixed support 6 to limit downward movement of the seat support 10 at the back. Also, the fixed support 6 has a planar nylon stop 16 at its front base. The stop 16 sets the lower limit for the seat at the front, and the stops 13 set the lower limit at the back.

The backrest support cross-bar 9 is inserted through nylon bushings 14 which are aligned with nylon stops 15 in the fixed support 6. Thus, the stops 15 in the fixed support limit the rearward movement of the backrest by abutment with the bushings 14.

An important aspect of the mounting of the seat and the backrest is that the seat has independent movement within the extremities set by the stops 13 and 16 on the fixed support The backrest has independent movement between a rearward extremity set by abutment of the bushings 14 with the stops 15 and a forward extremity set by abutment of the bushings 14 with the seat support 10. Thus, the forward extremity of the backrest occurs with abutment of the seat support 10 with the stop 16. However, before this happens, the bias on the backrest acts upon the seat also to counterbalance the bias on the seat. This is now described in more detail.

The fixed support 6 is generally U-shaped construction having upwardly-directed side walls. The seat support 10 is of inverted U-shaped construction having generally downwardly-depending side walls and is nested within the fixed support. The seat support 10 is biassed upwardly at the front in the clockwise direction as viewed in the drawings about the pin 8 by a spring 20. The spring 20 is a helical spring anchored on the base wall of the fixed support 6 and pressing upwardly against the web of the seat support 10 forwardly of the pivot pin 8.

The backrest support is urged in the anti-clockwise direction about the pin 8 by an outer spring 21 and an inner spring 22. These springs are anchored on the base web of the fixed support 6 rearwardly of the pin 8. The springs 21 and 22 press upwardly against the cross-bar 9 to urge the backrest support in the anti-clockwise direction as viewed in the drawings. The spring 20 is retained in position by retainers 25, and the springs 21 and 22 are retained by retainers 26.

It will be appreciated that the backrest and the seat are interconnected so that they actively induce and promote movement of the occupant's joints at any given position of the occupant's centre of gravity. The axes of these two supports are generally directly under the centre of gravity of the occupant and in this embodiment the axes are coincident. This is very important for ensuring balanced posture-responsive movement of the seat and the backrest whereby the bias forces are contra-rotational about an occupant's centre of gravity.

It is important that the seat is biassed upwardly at the front and the backrest is biassed forwardly. The forward bias of the backrest also imparts a bias upwardly on the seat at the rear when the backrest bushings 14 abut the seat support 10. Thus, the seat and the backrest together have a positive and proactive nesting/enclosing action around the occupant. This avoids the need for any user-operated control mechanism and the occupant has a totally passive role. The chair is thus inherently posture-responsive.

Referring to FIGS. 4 to 8 inclusive, some positions of the chair are illustrated. These are "snapshots" of particular positions during dynamic movement, given for clarity of understanding.

Figure 4:
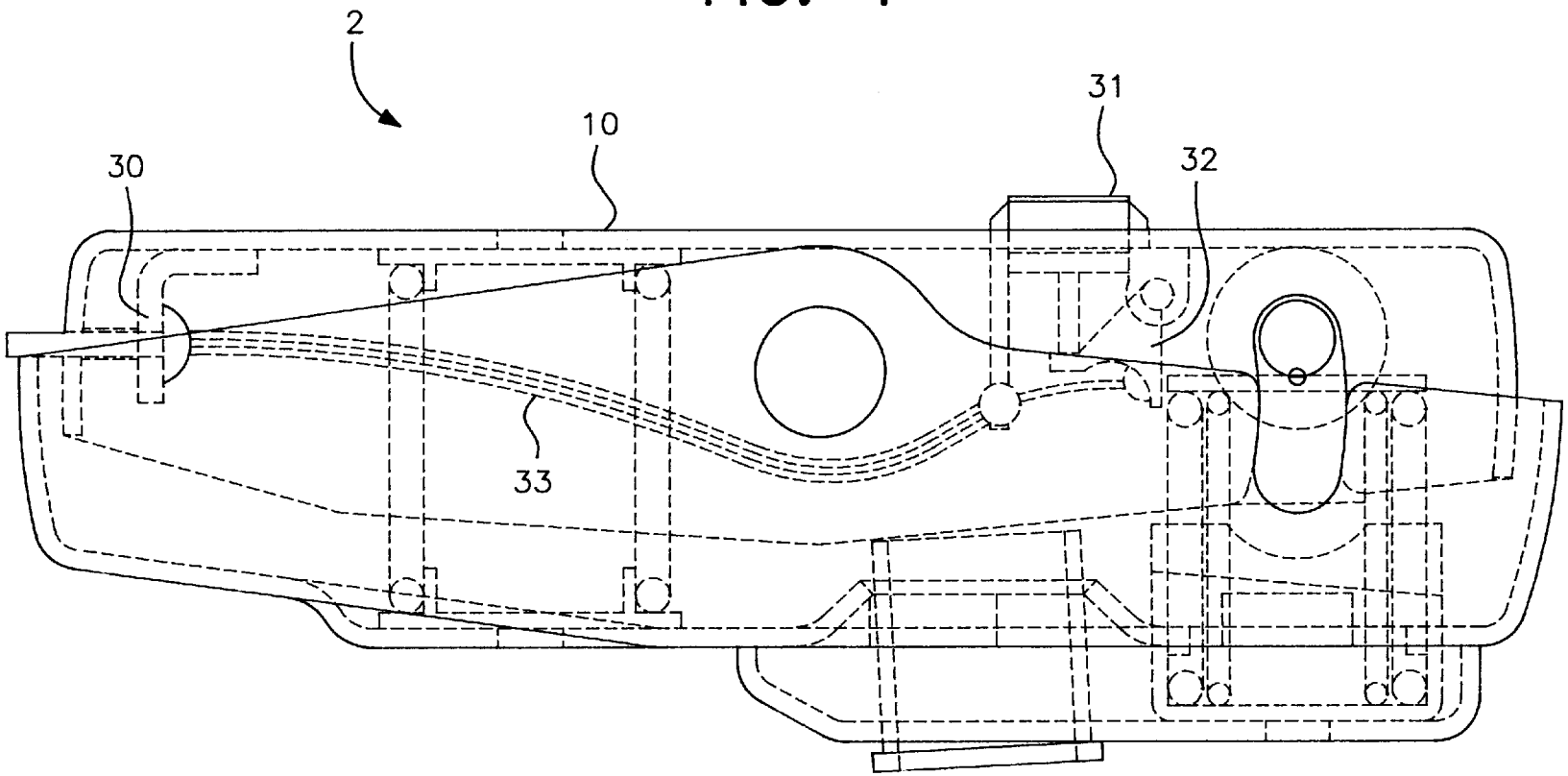
FIG. 4 is a diagrammatic cross-sectional side view showing the chair mechanism at mid (start) positions of the seat and backrest and showing a passive safety lock of the chair.

Referring to FIG. 4, a start position is illustrated. In this position, force exerted by the spring 20 matches that exerted by the springs 21 and 2 so that the chair is in a balanced position ready for an occupant. As illustrated, the seat is approximately horizontal as measured from the upper surface of the seat support 10. The backrest support, as measured by a line between the centres of the pin 8 and the cross-bar 9 is tilted very slightly rearwardly. These represent mid positions for the seat and the backrest. At this position both the spring 20 and the springs 21 and 22 are acting on the seat in opposed directions about the pin 8.

Figure 5:
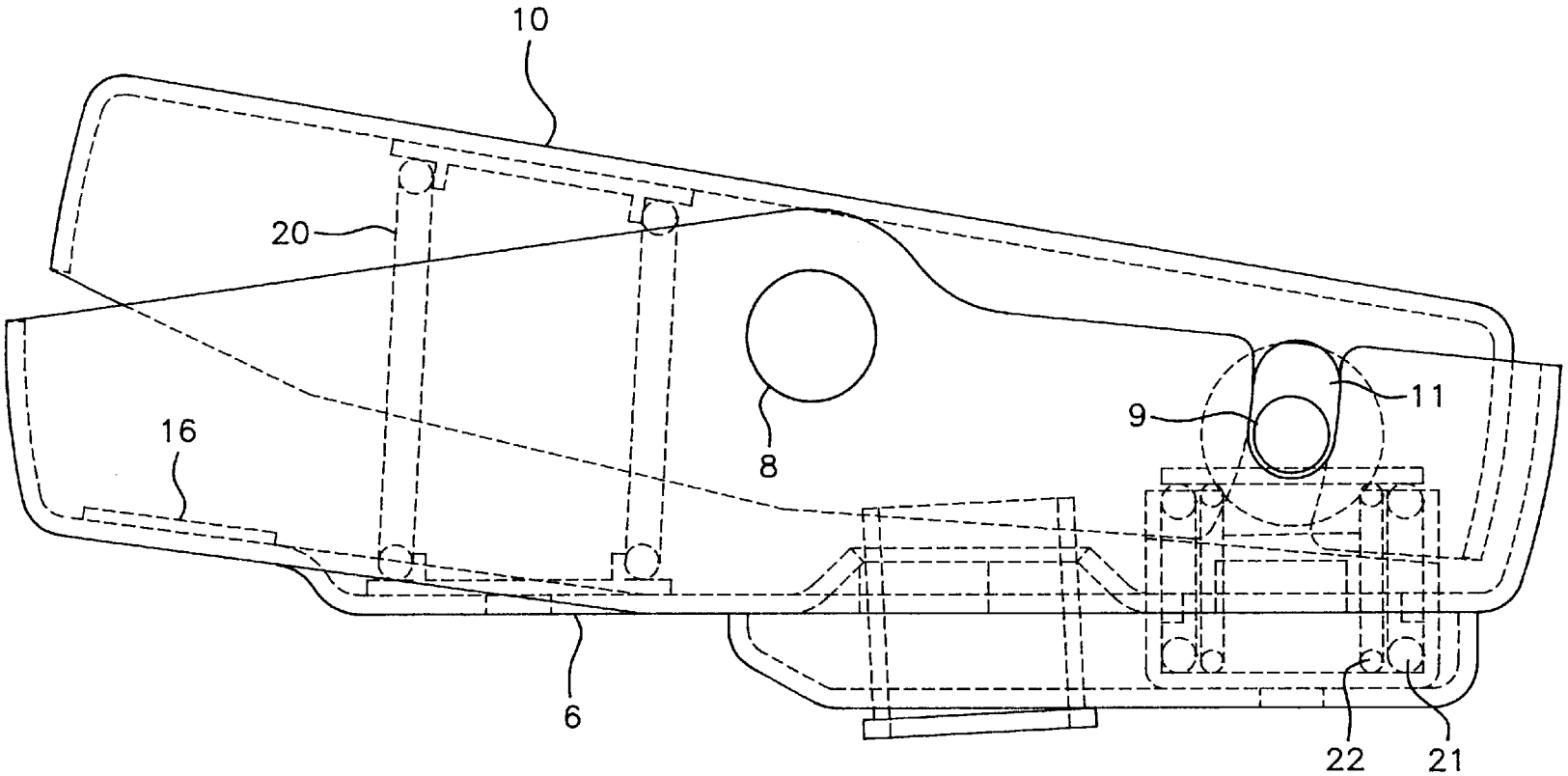
FIG. 5 is a diagrammatic cross-sectional side view showing the mechanism for seat-rearward and back-rearward positions.

Referring now to FIG. 5, when the occupant shifts his or her weight rearwardly, the springs 21 and 22 are compressed. This movement may aided by action of the spring 20. In the position shown in FIG. 5, neither the backrest or the seat are at their extreme positions. This position is simply set by the desired posture-of the occupant. The springs 20, 21, and 22 provide excellent support to the occupant at this self-selected position.

Figure 6:
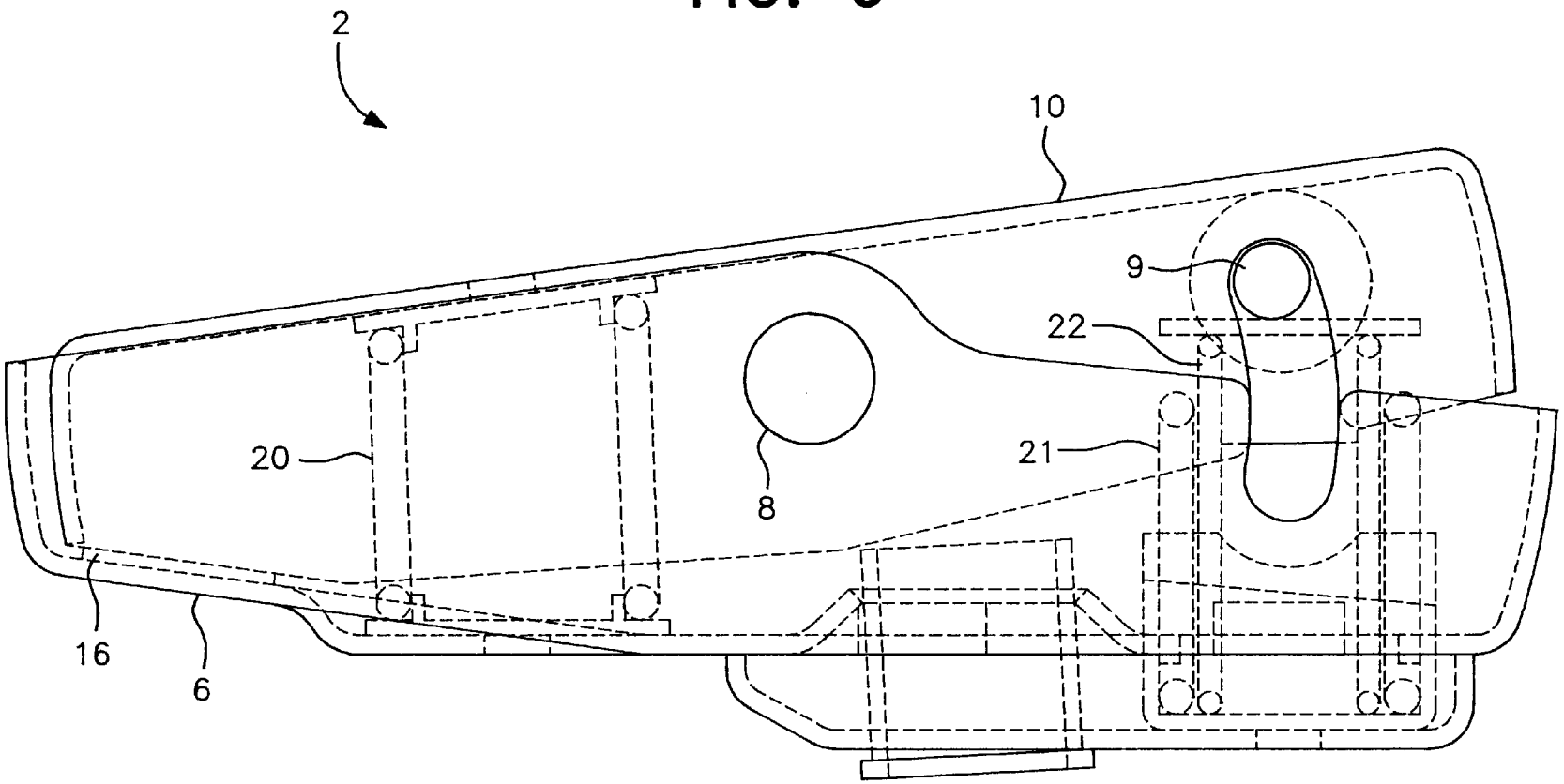
FIG. 6 is a diagrammatic cross-sectional side view for seat-forward and back-forward positions.

Referring now to FIG. 6, the seat is at a forward extremity at which the seat support 10 abuts against the pad 16 on the lower web of the fixed support 6. If the occupant begins with the position of FIG. 5, the position of FIG. 6 is reached by the occupant shifting his or her weight forwardly so that the spring 20 is compressed and the action is aided by the bias of the springs 21 and 22. The movement passes through a position at which the forces are equal and subsequently as the occupant shifts weight further forwardly, the spring 20 is further compressed. At this stage, the spring 22 begins to work independently of the spring 21 to urge the backrest forward with less force.

Figure 7:
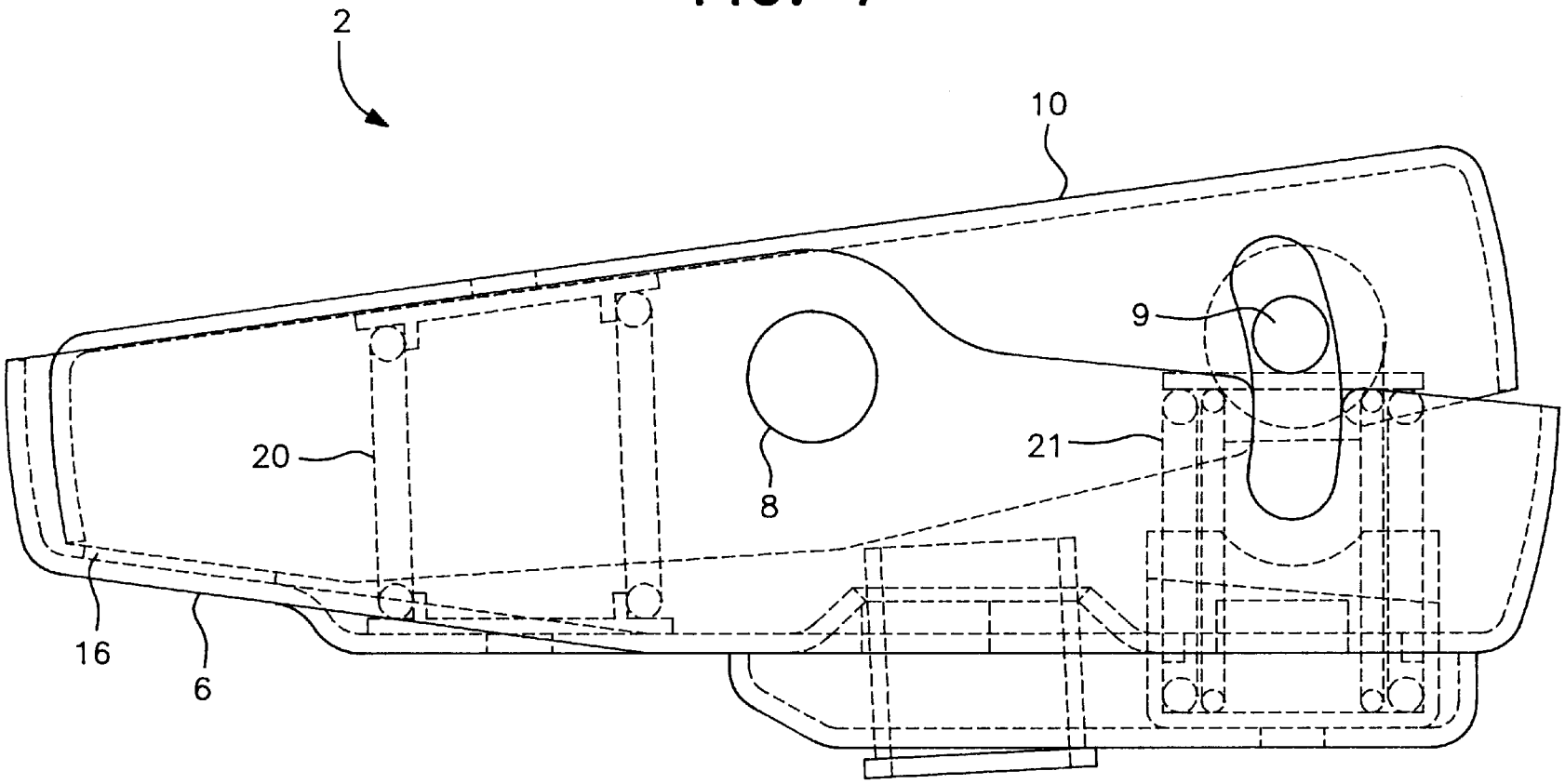
FIG. 7 is a diagrammatic cross-sectional side view for a forward seat position and a mid backrest position.
Figure 8:
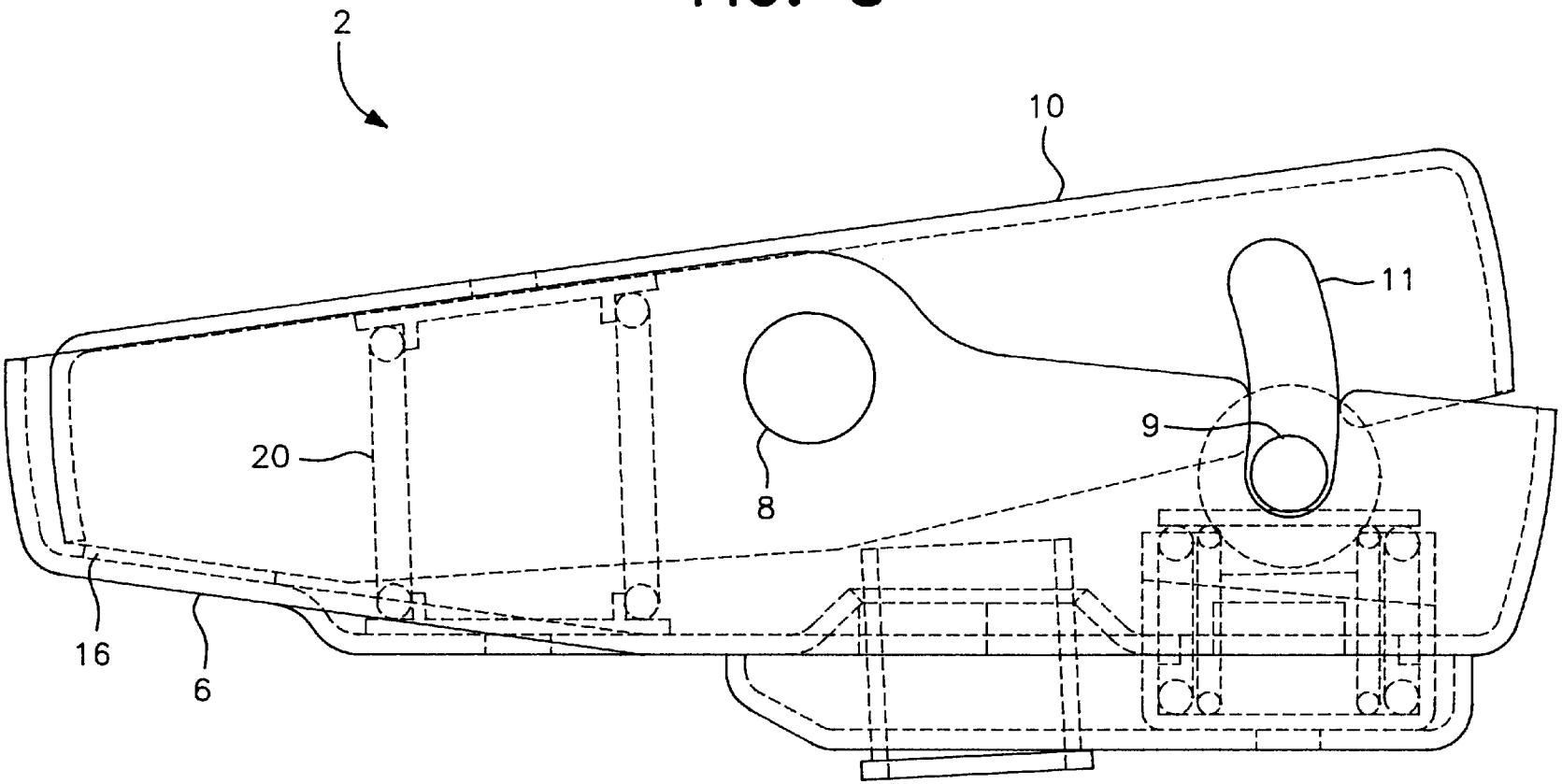
FIG. 8 is a diagrammatic cross-sectional side view for a forward position of the seat and a rearward position of the backrest.

As illustrated in FIGS. 7 and 8, the seat remains at the forward position However, the occupant has shifted his or her weight rearwardly so that his or her legs maintain the seat 4 at the forward position but the torso urges the backrest support rearwardly through a mid position shown in FIG. 7 to a limit position shown in FIG. 8 set by abutment against the stops 15. Again, the springs provide excellent support. It will be noted that the occupant can leave his or her feet on the ground even though the bulk of his or her weight leans back against the backrest. The chair provides excellent support through the full range of positions as the occupant changes posture. The pivot pin 8 is located approximately under the centre of gravity of the user at a mid position and the springs provide a balancing effect.

Referring again to FIG. 4, a passive safety mechanism 30 of the chair 1 is illustrated. It is illustrated only in FIG. 4 to avoid repetition and enhance clarity of the drawings. The safety mechanism 30 senses occupants weight rearwardly of the pin 8. A weight sensor 31 is depressed when the occupant's weight bears down on it. This rotates an arm 32, causing it to pull a cable 33, which in turn activates a bolt 34 to prevent locking the seat with respect to the fixed support 6.

When the sensor 31 does not sense weight, the bolt 34 remains in a default locked position to provide a safe and supportive seat if the occupant is sitting on the front edge only of the seat. The safety mechanism 30 thus prevents the seat from tilting to a forward extremity when the occupant is sitting in an towards the front. This in turn prevents the chair from becoming unbalanced. Again, user actuation is not required as the mechanism 30 actively operates unbeknownst to the occupant and the occupant's role is again totally passive.

It will be appreciated that the invention provides a chair which inherently changes its support configuration in a posture-responsive manner without a need for any actuators. The role of the occupant is totally passive. This is a dramatic advance over the prior art, in which it has been regarded that actuators are necessary to achieve different seat and backrest configurations for occupant support, or that it has been necessary to mechanically link the backrest and the seat so that they tilt in forced synchronism, irrespective of the desired posture of the occupant.

The chair automatically and actively supports the occupant during postural movements while promoting and inducing joint movement. This support is achieved with the occupant having an entirely passive role. He or she does not need to know how the chair operates and does not need to operate any actuators. This is achieved irrespective of the weight of the occupant and without the need for adjustment of a tension device. A combination of seat and backrest bias, seat and backrest individual freedom of movement and, and the location of the seat and backrest pivot axes provide this effect. It is also important that the pivot axes are directly under the centre of gravity of the occupant and the bias forces are contra-rotational about the occupant's centre of gravity.

In essence, the invention represents a radical departure, in which the occupant has an entirely passive role. Indeed, in practice, many occupants do not know how to operate actuators and many who do know do not bother. The invention solves these problems by avoiding the need for actuators.

Another advantage is that the chair has much fewer parts than in conventional chairs. Therefore, the chair is generally much more robust and reliable than conventional chairs.

These features of the chair provide very significant advantages in practice. The avoidance of a need to operate actuators and to adjust the chair also makes "hot-desking" much easier because the different users do not need to adjust each time. Another very significant advantage is ergonomic use—the constant movement (however small it may be) helps to avoid repetitive strain injury (RSI). The chair allows the occupant's body to move naturally whilst still being supported. Indeed, the chair actively and dynamically promotes movement at the occupant's joints. This, in turn, ensures that the occupant's muscles are kept in motion at all times without the occupant having to act or even think about it.

The configuration of the chair involves a backrest which extends downwardly and forwardly to the sides of the mechanism. The backrest arms at the sides are interconnected by the pin 8 and the cross-bar 9. These arms provide excellent foundations for support of auxiliary chair parts such as armrests. For a manufacturer, this makes provision of the option of armrests very simple, with the same basic chair construction being used.

The invention is not limited to the embodiments described, but may be varied in construction and detail. For example, the backrest may comprise a pivot pin having a splined and keyed arrangement for pressing against a spring. This would avoid the need for a cross-bar 9. Also, the springs may be of any other suitable type such as of polyurethane material.

What is claimed is:

1. A chair comprising a seat, a backrest, and a fixed support for the seat and the backrest, the seat and the backrest being each pivotally mounted for independent pivotal motion and the seat and the backrest being both biased to provide posture-responsive support of an occupant, a bias means acting to bias the seat upwardly at its front, and a bias means acting to bias the backrest forwardly whereby the bias forces are contra-rotational about an occupant's center of gravity, and the backrest bias being transferred to the seat by abutment of the backrest with the seat at some relative positions of the seat and the backrest, said bias transfer acting to bias the seat downwardly at its front.

2. A chair as claimed in claim 1, wherein the fixed support is of U-shaped channel construction and the seat comprises a seat support nested within the fixed support, and wherein the seat support is of inverted U-shaped channel construction.

3. A chair as claimed in claim 1, wherein the backrest is biased forwardly by at least two springs, whereby all springs act at a rearward extremity of the backrest pivotal motion and at least one spring ceases to act as the backrest moves forward.

4. A chair as claimed in claim 1, further comprising a safety mechanism comprising means for sensing presence of an occupant in the chair, and for preventing tilting of the seat downwardly at the front if the occupant is sitting at the front edge of the seat.

5. A chair as claimed in claim 1, wherein the fixed support comprises a stop means which sets extremities of independent movement of the seat, and wherein the fixed support comprises a stop means which sets a rearward extremity of movement of the backrest, and a forward extremity of the backrest is set by abutment with the seat.

6. A chair as claimed in claim 1, wherein the seat and the backrest pivot axes are located with respect to the seat to be substantially in the same vertical plane as the centre of gravity of an occupant sitting on the chair.

7. A chair as claimed in claim 6, wherein the seat and the backrest pivot axes are coincident, and extend through the fixed support.

8. A chair as claimed in claim 1, wherein the seat and the backrest are pivotally mounted on the fixed support, and wherein the seat is biased upwardly at its front by a spring acting between the fixed support and the seat forwardly of the seat pivot axis, and the backrest is biased forwardly by a spring acting between the fixed support and the backrest rearwardly of the backrest pivot axis.

9. A chair as claimed in claim 8, wherein the backrest and the seat are each pivotally mounted on a pivot pin extending through the fixed support.

10. A chair as claimed in claim 9, wherein the backrest comprises a pair of lateral supports interconnected by a pivot joint extending through the fixed support.

11. A chair as claimed in claim 10, wherein the backrest further comprises a cross-member interconnecting the lateral supports rearwardly of the pivot joint, and said cross-member is acted upon by a bias means urging the backrest forwardly.

12. A chair comprising a seat, a backrest, and a fixed support for the seat and the backrest, the seat and the backrest being each pivotally mounted for independent pivotal motion and the seat and the backrest being both biased to provide posture-responsive support of an occupant, the seat and the backrest being pivotally mounted on the fixed support, and the seat being biased upwardly at its front by a spring acting between the fixed support and the seat forwardly of the seat pivot axis, and the backrest being biased forwardly by a spring acting between the fixed support and the backrest rearwardly of the backrest pivot axis, the backrest and the seat being each pivotally mounted on a pivot pin extending through the fixed support, and the backrest including a pair of lateral supports interconnected by a pivot joint extending through the fixed support.

13. A chair as claimed in claim 12, wherein the backrest further comprises a cross-member interconnecting the lateral supports rearwardly of the pivot joint, and said cross-member is acted upon by a bias,means urging the backrest forwardly.

14. A chair comprising:

a seat which is pivotally mounted for rotation about a pivot axis;

a backrest which is pivotally mounted for rotation about a pivot axis, wherein said pivot axis is substantially coincident with that of the seat, and wherein said axis is located with respect to the seat to be located substantially under the center of gravity of an occupant of the chair;

a fixed support supporting the seat and the backrest and comprising:

stop means to limit downward pivoting of the seat, and stop means to limit rearward pivoting of the backrest;

a seat bias means urging upward pivotal movement of the seat at its front about its pivot axis; and a backrest bias means urging forward pivotal movement of the backrest about its pivot axis.

15. A chair as claimed in claim 14, wherein the seat and the backrest are each pivotally mounted on the fixed support.

16. A chair as claimed in claim 14, wherein the seat and the backrest comprise means for abutting for part of their pivot movement ranges so that the backrest bias means also acts on the seat during abutment, and the seat bias means also acts on the backrest during abutment, in which said biases counteract each other.

17. A chair as claimed in claim 14, wherein the fixed support comprises stop means to limit upward movement of the seat.

18. A chair as claimed in claim 17, wherein the stop means to limit upward movement of the seat and the stop means to limit rearward pivoting of the backrest comprising means for allowing further rearward pivoting of the backrest after the seat has reached its upper limit position.

19. A chair as claimed in claim 14, wherein the backrest bias means comprises means for applying reduced bias force for a forward extremity of pivoting of the backrest.

20. A chair mechanism comprising:

a fixed support, a seat support comprising means for supporting a seat pad, and a backrest support comprising means for supporting a backrest pad, the seat support and the backrest support being each pivotally mounted for independent pivotal motion, and the seat support and the backrest support being both biased to provide posture-responsive support of an occupant of a chair incorporating the mechanism, a bias means acting to bias the seat support upwardly at its front, and a bias means acting to bias the backrest support forwardly, the backrest support abuts with the seat support at some relative positions of the seat support and the backrest support whereby the backrest support bias being transferred to the seat support, said bias transfer acting to bias the seat support downwardly at its front.

21. A chair mechanism as claimed in claim 20, wherein the backrest support is biased forwardly by at least two springs, whereby all springs act at a rearward extremity of the backrest support pivotal motion and at least one spring ceases to act as the backrest support moves forwardly.

22. A chair mechanism as claimed in claim 20, further comprising a safety mechanism comprising means for sensing presence of an occupant and for preventing tilting of the seat pad support downwardly at the front if an occupant is sitting at a front edge of the seat.

23. A chair mechanism as claimed in claim 20, wherein the seat support and the backrest support are pivotally mounted on the fixed support, and wherein the seat support is biased upwardly at its front by a spring acting between the fixed support and the seat support forwardly of the seat support pivot axis, and the backrest support is biased forwardly by a spring acting between the fixed support and the backrest support rearwardly of the backrest support pivot axis.

24. A chair mechanism as claimed in claim 20, wherein the fixed support comprises a stop means which sets extremities of independent movement of the seat support, and wherein the fixed support comprises stop means which sets a rearward extremity of movement of the backrest support, and a forward extremity of movement of the backrest support is set by abutment of the backrest support with the seat support.

25. A chair mechanism as claimed in claim 20, wherein the seat support and the backrest support pivot axis are substantially coincident.

26. A chair mechanism as claimed in claim 25, wherein the backrest support and the seat support are pivotally mounted on a pivot pin extending through the fixed support.

27. A chair mechanism as claimed in claim 26, wherein the backrest support comprises a pair of lateral supports interconnected by a pivot joint extending through the fixed support.

28. A chair mechanism as claimed in claim 27, wherein the backrest support further comprises a cross-member interconnecting the lateral supports rearwardly of the pivot joint, and wherein the cross member is acted upon by a bias means urging the backrest support forwardly.

29. A chair mechanism as claimed in claim 20, wherein the fixed support is of U-shaped channel construction and the seat support is nested within the fixed support, and wherein the seat support is of inverted U-shaped channel construction.

30. A chair mechanism comprising:

a fixed support, a seat support comprising means for supporting a seat pad, and a backrest support comprising means for supporting a backrest pad, the seat support and the backrest support being each pivotally mounted for independent pivotal motion, and the seat support and the backrest support being both biased to provide posture-responsive support of an occupant of a chair incorporating the mechanism, the backrest support being biased forwardly by at least two springs, whereby all springs act at a rearward extremity of the backrest support pivotal motion and at least one spring ceases to act as the backrest support moves forwardly.

31. A chair mechanism comprising:

a fixed support, a seat support comprising means for supporting a seat pad, and a backrest support comprising means for supporting a backrest pad, the seat support and the backrest support being each pivotally mounted for independent pivotal motion, and the seat support and the backrest support being both biased to provide posture-responsive support of an occupant of a chair incorporating the mechanism, and a safety mechanism including means for sensing presence of an occupant and for preventing tilting of the seat support downwardly at the front if an occupant is sitting at a front edge of the seat.

32. A chair comprising a seat, a backrest, and a fixed support for the seat and the backrest, the seat and the backrest being each pivotally mounted for independent pivotal motion and the seat and the backrest being both biased to provide posture-responsive support of an occupant, the fixed support including a stop means which sets extremities of independent movement of the seat, and the fixed support including a stop means which sets a rearward extremity of movement of the backrest, and a forward extremity of the backrest being set by the abutment with the seat.

33. A chair mechanism comprising:

a fixed support, a seat support comprising means for supporting a seat pad, and a backrest support comprising means for supporting a backrest pad, the seat support and the backrest support being each pivotally mounted for independent pivotal motion, and the seat support and the backrest support being both biased to provide posture-responsive support of an occupant of a chair incorporating the mechanism, the seat support and the backrest support pivot axis being substantially coincident, the backrest support and the seat support being pivotally mounted on a pivot pin extending through the fixed support, the backrest including a pair of lateral supports interconnected by a pivot joint extending through the fixed support.

34. A chair mechanism as claimed in claim 33, wherein the backrest support further comprises a cross-member interconnecting the lateral supports rearwardly of the pivot joint, and wherein the cross member is acted upon by a bias means urging the backrest support forwardly.

35. A chair comprising a seat, a backrest, and a fixed support for the seat and the backrest, the seat and the backrest being each pivotally mounted for independent pivotal motion and the seat and the backrest being both biased to provide posture-responsive support of an occupant, the fixed support being of U-shaped channel construction and the seat including a seat support nested within the fixed support, and the seat support being of an inverted U-shaped channel construction.

36. A chair comprising a seat, a backrest, and a fixed support for the seat and the backrest, the seat and the backrest being each pivotally mounted for independent pivotal motion and the seat and the backrest being both biased to provide posture-responsive support of an occupant, the backrest being biased forwardly by at least two springs, whereby all springs act at a rearward extremity of the backrest pivotal motion and at least one spring ceases to act as the backrest moves forward.

37. A chair comprising a seat, a backrest, and a fixed support for the seat and the backrest, the seat and the backrest being each pivotally mounted for independent pivotal motion and the seat and the backrest being both biased to provide posture-responsive support of an occupant, and a safety mechanism including means for sensing presence of an occupant in the chair, and for preventing tilting of the seat, downwardly at the front if the occupant is sitting at the front edge of the seat.

38. A chair mechanism comprising:

a fixed support, a seat support comprising means for supporting a seat pad, and a backrest support comprising means for supporting a backrest pad, the seat support and the backrest support being each pivotally mounted for independent pivotal motion, and the seat support and the backrest support being both biased to provide posture-responsive support of an occupant of a chair incorporating the mechanism, the fixed support including a stop means which sets extremities of independent movement of the seat support, and the fixed support including stop means which sets a rearward extremity of movement of the backrest support, and a forward extremity of movement of the backrest support being set by abutment of the backrest support with the seat support.

39. A chair mechanism comprising:

a fixed support, a seat support comprising means for supporting a seat pad, and a backrest support comprising means for supporting a backrest pad, the seat support and the backrest support being each pivotally mounted for independent pivotal motion, and the seat support and the backrest support being both biased to provide posture-responsive support of an occupant of a chair incorporating the mechanism, the fixed support being of U-shaped channel construction and the seat support being nested within the fixed support, and wherein the seat support being of an inverted U-shaped channel construction.

* * * * *